United States Patent [19]

O'Grady

[11] 4,305,587

[45] Dec. 15, 1981

[54] MAGNETIC GAME AND METHOD

[76] Inventor: Gerald J. O'Grady, 1254 Ashover Dr., Bloomfield Hills, Mich. 48013

[21] Appl. No.: 71,407

[22] Filed: Aug. 30, 1979

[51] Int. Cl.[3] ..... A63B 67/06

[52] U.S. Cl. ..... 273/345

[58] Field of Search ..... 273/345, 239, 347, 348

[56] References Cited

U.S. PATENT DOCUMENTS

| | | | |
|---|---|---|---|
| 2,683,037 | 7/1954 | Ruczynski et al. . | |
| 3,026,110 | 3/1962 | Hess et al. | 273/345 |
| 3,093,919 | 6/1963 | Holtz | 273/239 X |
| 3,147,976 | 9/1964 | Millar . | |
| 3,161,410 | 12/1964 | Cunningham . | |
| 3,176,989 | 4/1965 | Harrison et al. | 273/345 |
| 3,573,869 | 4/1971 | Duckett | 273/347 |
| 3,894,736 | 7/1975 | Foley . | |
| 3,917,271 | 11/1975 | Lemelson et al. . | |
| 3,949,989 | 4/1976 | Van Meter . | |
| 3,967,823 | 7/1976 | Yount . | |
| 3,980,303 | 8/1976 | Bolton . | |
| 3,997,162 | 12/1976 | Scullin . | |
| 4,013,293 | 3/1977 | Hess et al. | 273/239 |
| 4,029,316 | 6/1977 | Clarke . | |
| 4,054,120 | 10/1977 | Foley . | |
| 4,055,343 | 10/1977 | Stuart . | |

FOREIGN PATENT DOCUMENTS

| | | | |
|---|---|---|---|
| 2322630 | 5/1977 | France | 273/345 |

*Primary Examiner*—Paul E. Shapiro

*Attorney, Agent, or Firm*—Harness, Dickey & Pierce

[57] ABSTRACT

This disclosure relates to a new target game and method for playing the same in which a relatively flat target board and relatively flat projectiles thrown at the target board exhibit magnetic attraction for one another to enable the projectiles to adhere to the target board. A second projectile thrown at the target board would be capable of adhering to the target board even when in at least partial overlapping relationship with a first projectile already adhering to the target board. Game rules may be developed to utilize the unlimited combinations of projectile adherence to different locations on the target board taken in conjunction with the overlapping adherence of one or more projectiles to the target board.

2 Claims, 5 Drawing Figures

FIG. 1.
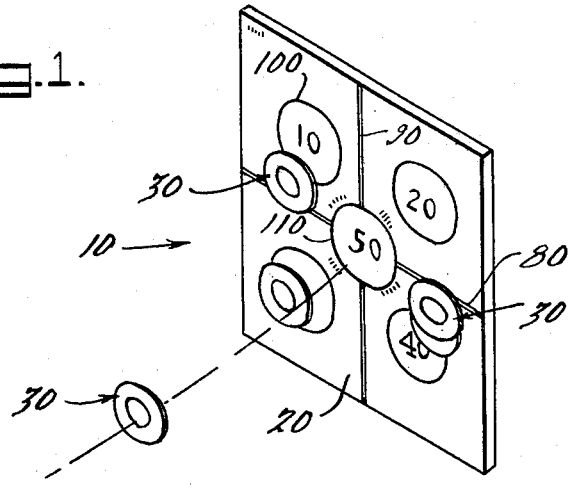
FIG. 2.
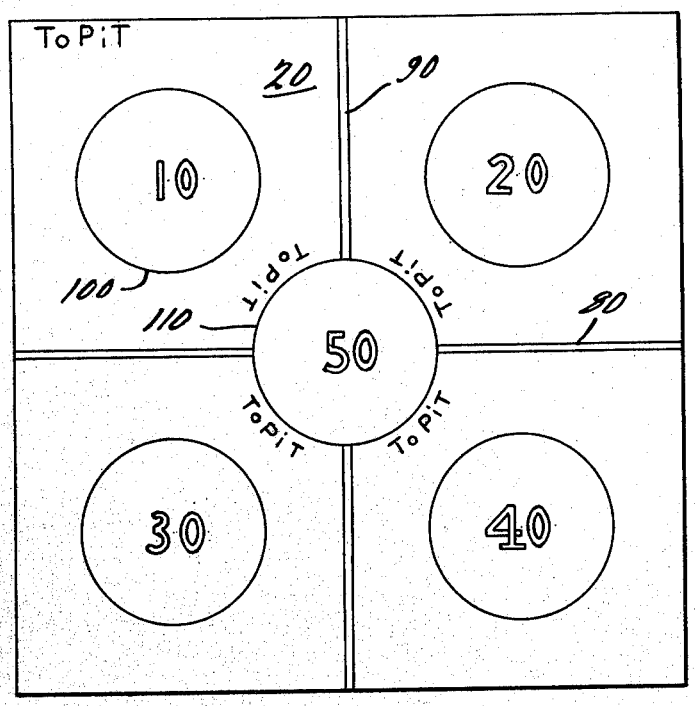
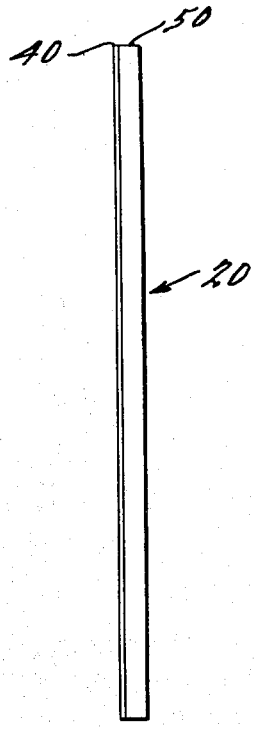
FIG. 3.
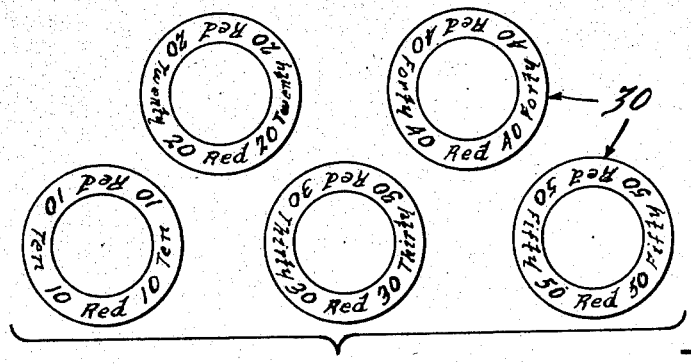
FIG. 4.
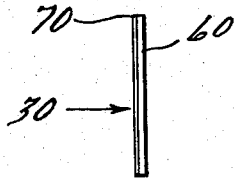
FIG. 5.

MAGNETIC GAME AND METHOD

BACKGROUND OF THE INVENTION

The present invention pertains primarily to game apparatus, and more particularly to target game apparatus using a target board and a projectile.

The following cited references are believed to be representative of the state of the art:

| U.S. Pat. No. | Inventor(s) | Issued |
|---|---|---|
| 2,683,037 | Ruczynski et al | July 6, 1954 |
| 3,147,976 | Millar | September 8, 1964 |
| 3,161,410 | Cunningham | December 15, 1964 |
| 3,894,736 | Foley | July 15, 1975 |
| 3,917,271 | Lemelson et al | November 4, 1975 |
| 3,949,989 | Van Meter | April 13, 1976 |
| 3,967,823 | Yount | July 6, 1976 |
| 3,980,303 | Bolton | August 14, 1976 |
| 3,997,162 | Scullin | December 14, 1976 |
| 4,029,316 | Clarke | June 14, 1977 |
| 4,054,120 | Foley | October 18, 1977 |
| 4,055,343 | Stuart | October 25, 1977 |

Generally, target games are made up of a target board which may contain a bullseye or be otherwise divided up into sections, and a set of projectiles such as darts which are thrown at the target board. Many attempts have been made to make a dart board type target game safe for general use by putting suction, magnetic, or Velcro (textile hook and loop) tips on the darts which would then adhere to a suitable target board. Also, the bodies of the darts themselves have been modified by making them out of foam or the like to enhance safety as well as add variety to the games developed.

It is a principle object of the present invention therefore to provide a new target game and method for playing the same.

Another object of the present invention is to provide a safe, magnetic target game and method which provides enjoyment and aids in throwing development for all ages.

It is a further object of the present invention to provide an interesting target game and method in which the overlapping capabilities of the projectiles enable unlimited game rules to be developed.

Other objects, features and advantages of the present invention will become apparent from the subsequent description and the appended claims taken in conjunction with the accompanying drawings.

SUMMARY OF THE INVENTION

In accordance with the present invention, a target game and method for playing the same is provided which is comprised of a target board having a relatively flat surface and at least two relatively flat projectiles for throwing at the target board. The target board and the projectiles exhibit magnetic attraction for one another to enable the projectiles to adhere to the target board. In addition, a second projectile thrown at the target board is capable of adhering to the target board even when in at least partial overlapping relationship with a first projectile already adhering to the target board.

BRIEF DESCRIPTION OF THE DRAWINGS

The foregoing objects and others will be pointed out more fully hereinafter in conjunction with the description of the preferred embodiment of the present invention illustrated in the accompanying drawings and examples and in which:

FIG. 1 is a perspective view of the magnetic game of the present invention;

FIG. 2 is a plan view of the target board of the present invention;

FIG. 3 is an end view of the target board;

FIG. 4 is a plan view of some of the projectiles of the present invention; and FIG. 5 is an end view of one of the projectiles.

DESCRIPTION OF THE PREFERRED EMBODIMENT

Referring now to the drawings wherein the showings are for the purpose of illustrating a preferred embodiment of the invention only and are not for the purpose of limiting the invention, FIG. 1 shows the magnetic game 10 of the present invention with the target board 20 having several projectiles 30 thereon, some of which are shown in overlapping relationship. An additional projectile is shown en route to the target board.

FIGS. 2 and 3 more closely show the target board 20 which in this embodiment is comprised of a relatively flat surface 40 and a rigid foam back-up or support member 50. Surface 40 is metallic and is formed from sheet metal such as sheet steel or the like, but any material is acceptable as long as it is capable of exhibiting magnetic interaction with respect to the projectiles 30. It is also contemplated that the surface 40 may itself be magnetic with the projectiles being made of metal or of some other magnetizable material as long as the projectiles are capable of adhering to the surface of the target board 20. In order to reduce weight and increase portability of the target board, the support member 50 may be made of light-weight plastic such as expanded cellular polystyrene sheet, wood, or any such material. This support surface may be provided with attaching means of some type for mounting the target board 20 on a wall or post, or may be provided with extendible legs for supporting the target game vertically on a planar horizontal surface such as a floor.

FIGS. 4 and 5 more clearly show the projectiles 30 of the present invention which are disc-shaped as shown. Other geometric shapes are possible as long as the projectiles are relatively flat and are capable of being thrown through the air and of adhering to the target board 20. The projectiles should also be capable of adhering to the target board 20 when positioned on top of, or in an overlapping relationship (either total or partial), with another projectile already adhering to the target board. The projectiles are comprised of a magnetic layer means 60 and a surface layer means 70. The magnetic layer means is made up of magnetic particles dispersed in a synthetic resin binder, which construction allows the projectiles to be flexible and also enables less costly manufacture of the projectiles since such magnetic resin is usually available in sheet stock and may easily be cut to the desired size and shape. Other materials such as magnet stock are of course possible. The surface layer means 70 is made from vinyl sheet which is easily laminated onto the magnetic resin sheet of the magnetic layer means 60 described above, but other similar materials are also possible, such as a thin film or decal, or even no surface layer at all, with only an ink printing directly on the magnetic layer means, thereby giving magnetic qualities to both sides of the projectile and also giving better projectile-to-projectile adherence.

In the preferred embodiment shown in FIG. 2, the target board is of generally rectangular or square shape and is divided into four equal rectangular or square sections by two intersecting axes, horizontal axis 80 and vertical axis 90. Each of the generally square sections contains a circle 100 in its center with another circle 110 centered at the intersection of the axes. Each circle has a number marked therein for purposes of scoring in playing the game of the present invention.

The disc-shaped projectiles 30 shown in FIG. 4 are marked with a smaller concentric circle thereon and are also marked with various scoring numbers and color designations for use in playing the game of the present invention. For example, a disc may be marked with the number "40" to indicate that forty points are scored if the disc lands in some designated spot on the target board. If one disc completely overlaps the smaller concentric circle of another disc, the score awarded by virtue of playing the first disc could be cancelled. Any number of colors may be used, with each color being used to designate a set of discs to enable play by more than one player or team. For example, four sets of discs may be provided (red, blue, yellow, green), with each set containing a full range of disc scores (10, 20, 30, 40, 50).

The number of combinations and permutations possible in setting up rules to play the game of the present invention is unlimited. The number of sections and scoring circles on the target board, as well as the number of discs and the random way in which they adhere to the surface of the target board and overlap each other provide the basis for an infinite number of game variations.

It should of course be appreciated that the target board and projectiles may be of any shape as long as the requisite magnetic interaction is present to enable the projectiles to adhere to the surface of the target board. Limitless variations are possible bounded only by the imagination of the individual creating a set of rules by which to utilize the game and method of the invention described herein.

From a method aspect, the present invention comprises utilizing the above described game apparatus to play a target game comprising throwing a first projectile at the target board so that it adheres to the target board by virtue of the magnetic interaction therebetween, and then throwing a second projectile at the target board so that it also adheres to the target board even when in at least partial overlapping relationship with the first projectile. The score in the game would be determined by noting the positions of the projectiles on the game board. FIG. 1 shows several discs 30 on the target board 20. The disc in the lower left hand corner of the game board might be worth thirty points since it is mostly within the circle marked "30" on the target board. The disc above it in the upper right hand corner of the board would not receive any score since it is mostly outside the circle marked "10". The discs in the lower right hand corner of the target board would not receive any score since the second or upper disc totally overlaps the smaller concentric circle of the lower disc, thereby cancelling out any score the first or lower disc may have been entitled to.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

What is claimed is:

1. A method of playing a game utilizing a target board having a relatively flat metallic surface adapted for adherence of magnetic objects thereto, and at least two relatively flat magnetic discs for throwing at said target board, said target board and said discs exhibiting magnetic attraction for one another to enable said discs to adhere to the metallic surface of said target board, said surface of said target board being of generally rectangular shape and being divided into four generally rectangular sections of substantially equal area by means of a generally horizontal axis and a generally vertical axis intersecting at the center of the surface of the target board, each of said generally rectangular sections having a scoring circle in the center thereof, with an additional scoring circle centered at the intersection of said axes, each of said circles having scoring indicia therein and each of said discs having a circular shaped centrally located inner area and an annular shaped outer peripheral area extending around the inner area, each of said discs having further scoring indicia thereon, said method comprising:

throwing a first disc at said target board so that it adheres to said target board, throwing a second disc at said target board so that it adheres to said target board even when in partial overlapping relationship with said first projectile, determining scoring by noting the positions of said projectiles on said target board relative to each other and relative to the circles in the center of said four generally rectangular sections, further determining scoring by noting the positions of said projectiles on said target board relative to each other and relative to the circle centered at the intersection of said horizontal and vertical axes, adding to the score the value of the scoring indicia of any circle within which a disc's position is noted, adding to the score the value of the scoring indicia of a disc which lands in some designated spot on the target board, and cancelling the score of a previously thrown disc which has the inner area thereof completely hidden from view by a subsequently thrown overlying disc.

2. The method of claim 1 wherein said discs comprise magnetic layer means adapted to adhere to the surface of said target board and surface layer means having markings thereon.

* * * * *